US012637738B2

(12) United States Patent
Wilkomirsky Fuica et al.

(10) Patent No.: US 12,637,738 B2
(45) Date of Patent: May 26, 2026

(54) METHOD FOR PRODUCING COPPER METAL FROM COPPER CONCENTRATES WITHOUT GENERATING WASTE

(71) Applicant: UNIVERSIDAD DE CONCEPCION, Concepcion (CL)

(72) Inventors: Igor Wilkomirsky Fuica, Concepcion (CL); Fernando Antonio Parada Luna, Concepcion (CL); Eduardo Balladares Varela, Concepcion (CL); Roberto Parra Figueroa, Concepcion (CL)

(73) Assignee: UNIVERSIDAD DE CONCEPCION, Concepcion (CL)

( * ) Notice: Subject to any disclaimer, the term of this patent is extended or adjusted under 35 U.S.C. 154(b) by 664 days.

(21) Appl. No.: 17/755,992

(22) PCT Filed: Oct. 21, 2020

(86) PCT No.: PCT/CL2020/050139
§ 371 (c)(1),
(2) Date: May 13, 2022

(87) PCT Pub. No.: WO2021/092706
PCT Pub. Date: May 20, 2021

(65) Prior Publication Data

US 2022/0396851 A1 Dec. 15, 2022

(30) Foreign Application Priority Data

Nov. 13, 2019 (CL) ..... 3246-2019

(51) Int. Cl.
*C22B 15/00* (2006.01)
*C22B 1/10* (2006.01)
(Continued)

(52) U.S. Cl.
CPC ..... *C22B 15/0028* (2013.01); *C22B 1/10* (2013.01); *C22B 1/26* (2013.01); *C22B 3/14* (2013.01);
(Continued)

(58) Field of Classification Search
CPC ..... C22B 15/0028; C22B 15/0015; C22B 15/006; C22B 1/00; C22B 1/02; C22B 1/10
See application file for complete search history.

(56) References Cited

U.S. PATENT DOCUMENTS 153,573 A * 7/1874 Kidwell ..... C22B 15/0054 75/424
2,878,102 A * 3/1959 Sternfels ..... C22B 15/0013 423/150.5
(Continued)

FOREIGN PATENT DOCUMENTS

CN 104404260 A * 3/2015
CN 105154687 A * 12/2015
(Continued)

OTHER PUBLICATIONS

Garcia Opazo, "Estudio Preliminar De Laboratorio Para El Tratamiento De Un Concentrado De Cobre Alto En Arsénico Mediante Tostación Sulfatante", Universidad De Concepción Facultad de Ingeniería Departamento de Ingeniería Metalúrgica, 2017, pp. 1-101.
(Continued)

*Primary Examiner* — Brian D Walck
*Assistant Examiner* — Austin Pollock
(74) *Attorney, Agent, or Firm* — LUCAS & MERCANTI, LLP

(57) ABSTRACT

A method for producing copper metal from copper concentrates without generating waste by: (a) oxidizing copper concentrate; (b) cleaning and cooling the gases; (c) feeding
(Continued)

to a reduction reactor; (d) cleaning the gases; (e) discharging hot powders and calcines into water; (f) performing magnetic separation; (g) thickening and filtering the magnetic fraction; (h) floating silica and inert materials; (i) thickening and filtering the silica and inert materials; (j) thickening and filtering the final concentrate containing the copper metal and noble metals; (k) smelting the final concentrate of copper and noble metals; and (l) recirculating ground smelt slag to a roasting reactor.

12 Claims, 8 Drawing Sheets

(51) Int. Cl.

| | |
|---|---|
| ***C22B 1/26*** | (2006.01) |
| ***C22B 3/14*** | (2006.01) |
| ***C22B 5/12*** | (2006.01) |
| ***C22B 11/00*** | (2006.01) |
| ***C22B 34/34*** | (2006.01) |

(52) U.S. Cl.
CPC ..... *C22B 5/12* (2013.01); *C22B 11/04* (2013.01); *C22B 15/0015* (2013.01); *C22B 15/006* (2013.01); *C22B 34/34* (2013.01)

(56) References Cited

U.S. PATENT DOCUMENTS 3,589,892 A * 6/1971 David ..... C22B 5/00 75/363
4,006,010 A * 2/1977 Rajcevic ..... C22B 15/0054 75/643
2011/0195016 A1* 8/2011 Hammerschmidt ..... C22B 1/10 423/561.1

FOREIGN PATENT DOCUMENTS

CN 107641717 A * 1/2018 ..... C22B 11/02
GB 306566 A * 2/1929 ..... C22B 15/0067
GB 321685 A * 11/1929 ..... C22B 15/0006
GB 731527 A 6/1955
GB 1389145 A * 4/1975 ..... C22B 23/005
WO WO-0050652 A1 * 8/2000 ..... C21C 5/5229
WO WO-2016075368 A1 * 5/2016 ..... C22B 15/0015
WO 2016180624 A1 11/2016

OTHER PUBLICATIONS

Rambiyana et al., "Fire and brimstone: The roasting of a Merensky PGM concentrate", The Journal of The Southern African Institute of Mining and Metallurgy, 2015, vol. 115, pp. 507-514.
Ke Qing etal., "Recovery of iron from copper slag by deep reduction and magnetic beneficiation", International Journal of Minerals, Metallurgy and Materials, 2013, vol. 20, No. 11, pp. 1035-1041.
International Search Report for Corresponding International Application No. PCT/CL2020/050139, 3 pages, Feb. 5, 2021.

* cited by examiner

METHOD FOR PRODUCING COPPER METAL FROM COPPER CONCENTRATES WITHOUT GENERATING WASTE

CROSS REFERENCE TO RELATED APPLICATIONS

This Application is a 371 of PCT/CL2020/050139 filed on Oct. 21, 2020, which claims the benefit of Chilean Patent Application No. 3246-2019 filed on Nov. 13, 2019, the contents of each application are incorporated herein by reference.

Technical Area

The technology is oriented to the mining area, more particularly, corresponds to a process to produce copper metal from copper concentrates without generating waste.

PRIOR ART

For more than 100 years, blister copper production technology has remained virtually stagnant, and while it has allowed the production of blister copper at a competitive price until 1 or 2 decades ago, its intrinsic limitations due to the inevitable leakage of gases with sulfur dioxide ($SO_2$) and the formation of a large quantity of slags, make it necessary to have radically different alternatives not only in terms of capital costs and operation of the plants, but also in their potential degree of automation, zero emissions of gases into the environment, generation of slags and recovery of other metals contained in the copper concentrates, that is, a "zero waste" process for the 21st century.

Although some more advanced fusion/conversion technologies have emerged such as the Outokumpu-Kennecott, Mitsubishi and Ausmelt, they all generate between 0.8 to 1.2 tons of slag per ton of blister copper generated, and the global capture of sulfur as $SO_2$ even with the best technology does not exceed 98%. In addition, only copper and noble metals are recovered from the copper concentrate, discarding others of commercial value contained in the concentrates such as molybdenum, zinc, and iron.

Chile, which is the largest copper producer in the world, has only made a significant contribution to the copper smelting technology with the Lieutenant Converter (CT), which is already more than half a century old, and there is no new technology in development that exceeds the limitations of the current ones.

Fugitive emissions of gases containing $SO_2$ into the environment, as well as the generation of slag in all copper concentrate smelting processes are two widespread problems. The slag contains between 2 to 10% copper and must be reprocessed, and still end up with 0.5-0.8% copper and other metals of commercial value that represent an environmental liability of great magnitude. In Chile it is estimated that there are about 50 million tons of slag in the dumps, and that they also contain about 2 million tons of copper, already unrecoverable.

On the other hand, the new Chilean environmental legislation capturing 95% of $SO_2$ (D.S. No, 28/2013, of the MMA, published on Dec. 12, 2013) which entered into force in 2019 and future of 98% can make several of the Chilean smelters technically and economically unviable, which would bring Chile back to a country that only produces concentrates, which predicts a future complex for the seven Chilean copper smelters.

There is no combined process to date, being the only technology developed by the company AMAX Inc. of the United States[1] in which copper concentrates are roasted (oxidized) with air at 880° C. up to low 1% sulfur and then the calcine is pelletized with coal or coke to reduce it and smelt at 1200-1300° C. in an open hearth, cupola or rotary kiln. As can be seen, in this patent the calcine must be smelted to reduce it, forming a large amount of slag with 6 to 12% of copper, since nothing of the iron is previously eliminated. The process was tested on a demonstration scale and not industrially applied, possibly due to this limitation.

(1) "H. P. Rajcevic, W. R. Opie and D. C. Cusanelli, "*Production of blister Copper from calcined Copper-iron concentrates*", U.S. Pat. No. 4,072,507, (Feb. 7, 1978).

Reductive roasting from hematite ($Fe_2O_3$) to magnetite ($Fe_3O_4$) has been commercially used for several decades (2)(3) for iron minerals containing low-grade hematite that cannot be concentrated, so that by transforming the hematite into magnetite it can be easily concentrated in magnetic form, so that it is an established technology for hematitic iron minerals.

(2) Wade H. H. and Schulz, N. F., "*Magnetic roasting of iron ones*", Min. Engr., No. 11, p. 1161-1165, (1960).

(3) G. Uwadiale, "*Magnetizing roasting ofiron ores*", Min. Processes and Extr. Metallurgy Review, Vol. 11, Nos. 1 and 2, p. 68-70, (1992).

Based on this background, there is still a need to develop new technologies to produce copper metal from copper concentrates that are efficient and environmentally friendly.

DISCLOSURE OF THE INVENTION

The present technology corresponds to a process for producing copper metal from copper concentrates without generating waste. Unlike conventional casting processes, in this invention the melting temperature of the materials is not reached, since it is operated at a temperature at which reactions occur between solids and gases, and not between molten materials.

The process comprises two main and two secondary stages. In the first main stage, the copper concentrate is oxidized (roasted) with air in an environmentally closed system that virtually removes the entire sulfur as $SO_2$ to produce sulfuric acid, leaving a virtually sulfur-free oxidized calcine where the copper, iron and other metals are transformed to their respective more stable oxides.

In the second main stage, the oxidized calcine is reduced to copper metal and magnetite in a second reactor at 500-950° C. using coal, carbon monoxide or hydrogen as reducers, to finally separate the copper from the iron in magnetic form and then the sterile one (mainly silica), in order to obtain a final product of copper metal and noble metals to be melted and electrolytically refined in conventional form, also recovering the iron as a concentrate of magnetite, silica, zinc and molybdenum (if any in the initial concentrate), all as commercial products.

In this way, and unlike the conventional smelting processes currently in use, no slag is generated, nor fugitive gases with $SO_2$, therefore all the metals contained in the fed copper concentrate are recovered.

For a better understanding of this invention, a detailed description of the process will be made below, referring to FIGS. 1-8.

Figure 1:
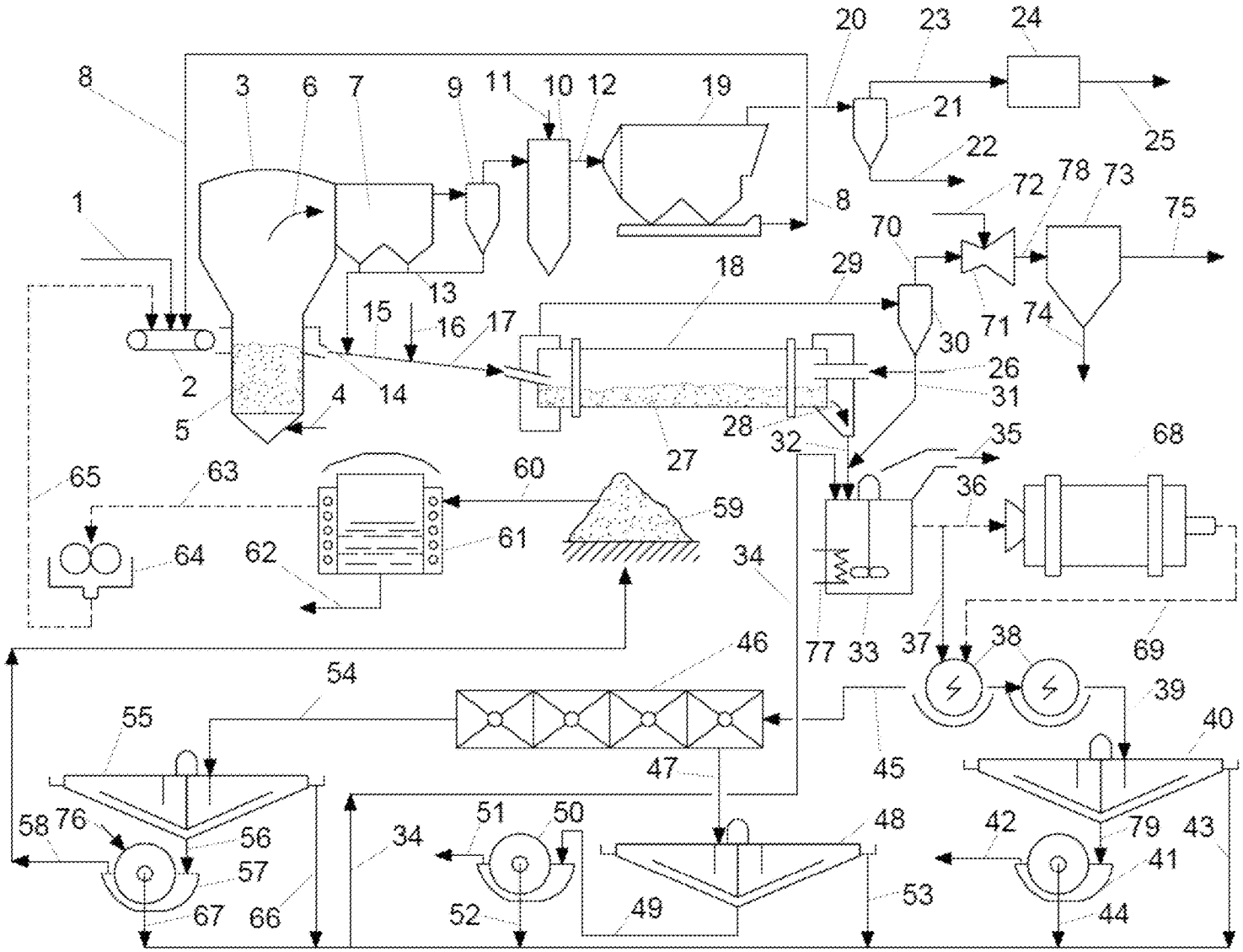
FIG. 1: Schematic of the process for producing copper metal from copper concentrates.

In FIG. 1, a dry or wet copper concentrate 1 with up to 12% humidity is fed by a conventional system 2 to a conventional fluidized bed roasting reactor 3, which operates between 650 to 900° C., preferably between 700 to 850° C. using air 4 or oxygen-enriched air so that the following reactions occur in the fluidized bed 5 for a typical copper concentrate containing chalcopyrite ($CuFeS_2$), covelite ($CuS$), chalcocite ($Cu_2S$) and pyrite ($FeS_2$):

$$CuFeS_{2(s)}+3.25O_{2(g)}=CuO_{(s)}+0.5Fe_2O_{3(s)}+2SO_{2(g)} \quad (1)$$

$$CuS_{(s)}+1.5O_{2(g)}=CuO_{(s)}+SO_{2(s)} \quad (2)$$

$$Cu_2S_{(s)}+2O_{2(g)}=2CUO_{(s)}+SO_{2(g)} \quad (3)$$

$$FeS_{2(s)}+2.75O_{2(g)}=0.5Fe_2O_{3(s)}+2SO_{2(g)} \quad (4)$$

$$CuO_{(s)}+Fe_2O_{3(s)}=CuO\cdot Fe_2O_{3(s)} \quad (5)$$

The extent to which reaction (5) of cupric ferrite formation ($CuO\cdot Fe_2O_3$) occurs is variable and depends on the reaction temperature and time. At 800° C., about 15% of the copper contained in the concentrate forms copper ferrite.

The reaction time in reactor 3 ranges between 2 to 12 h, preferably between 4 to 8 h, using air or oxygen-enriched air between 21 to 100% by volume of oxygen and an excess of air (oxygen) employed with respect to the stoichiometric required by reactions (1) to (4), which ranges from 0.001 to 200%, preferably between 50 and 100% excess.

Figure 2:
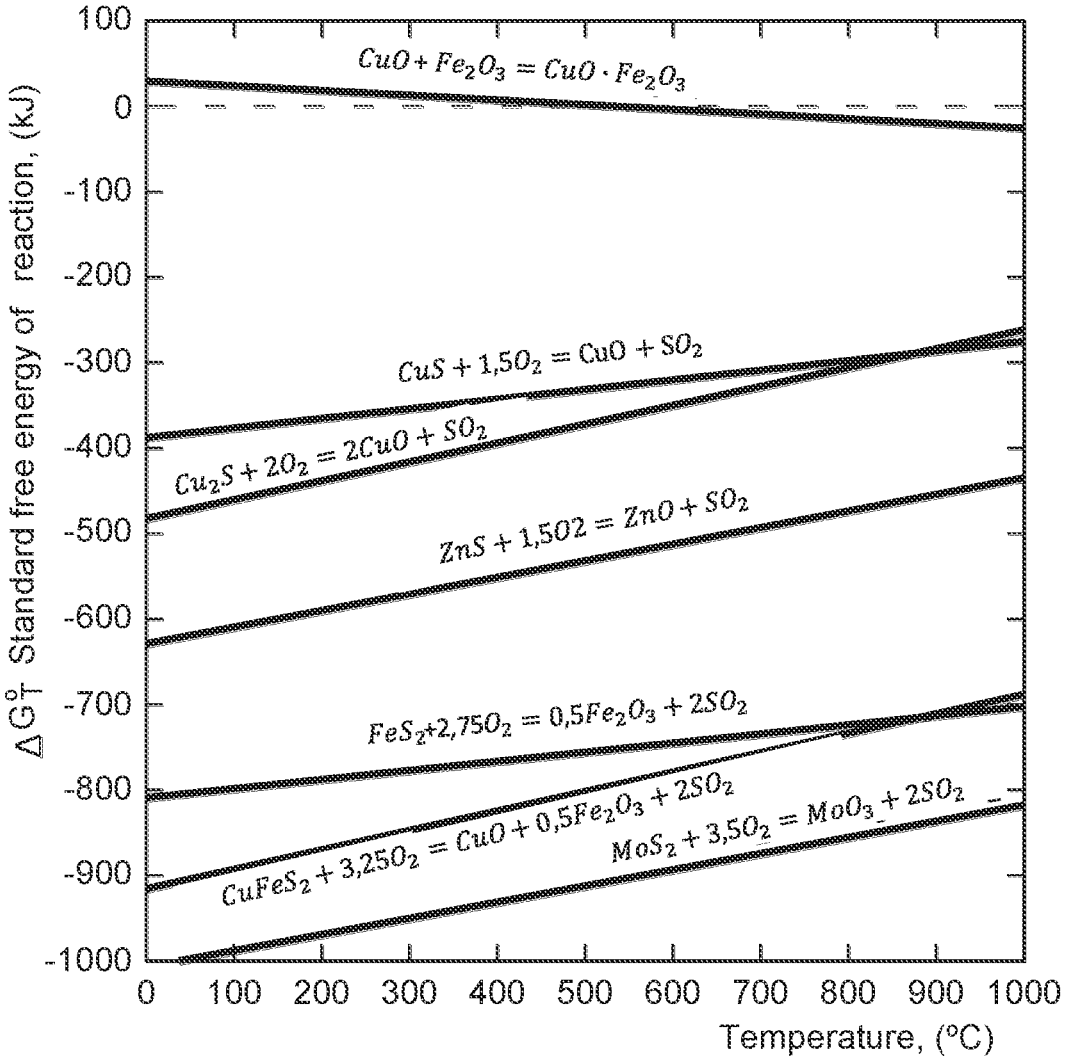
FIG. 2: Graph of Standard free energy of reaction of mineral compounds.

All these reactions are spontaneous with negative values (by convention) of their standard reaction free energies as seen in FIG. 2, where the values of the standard reaction free energies with oxygen of mineral compounds generally present in copper concentrates as a function of the reaction temperature are plotted.

Figure 3:
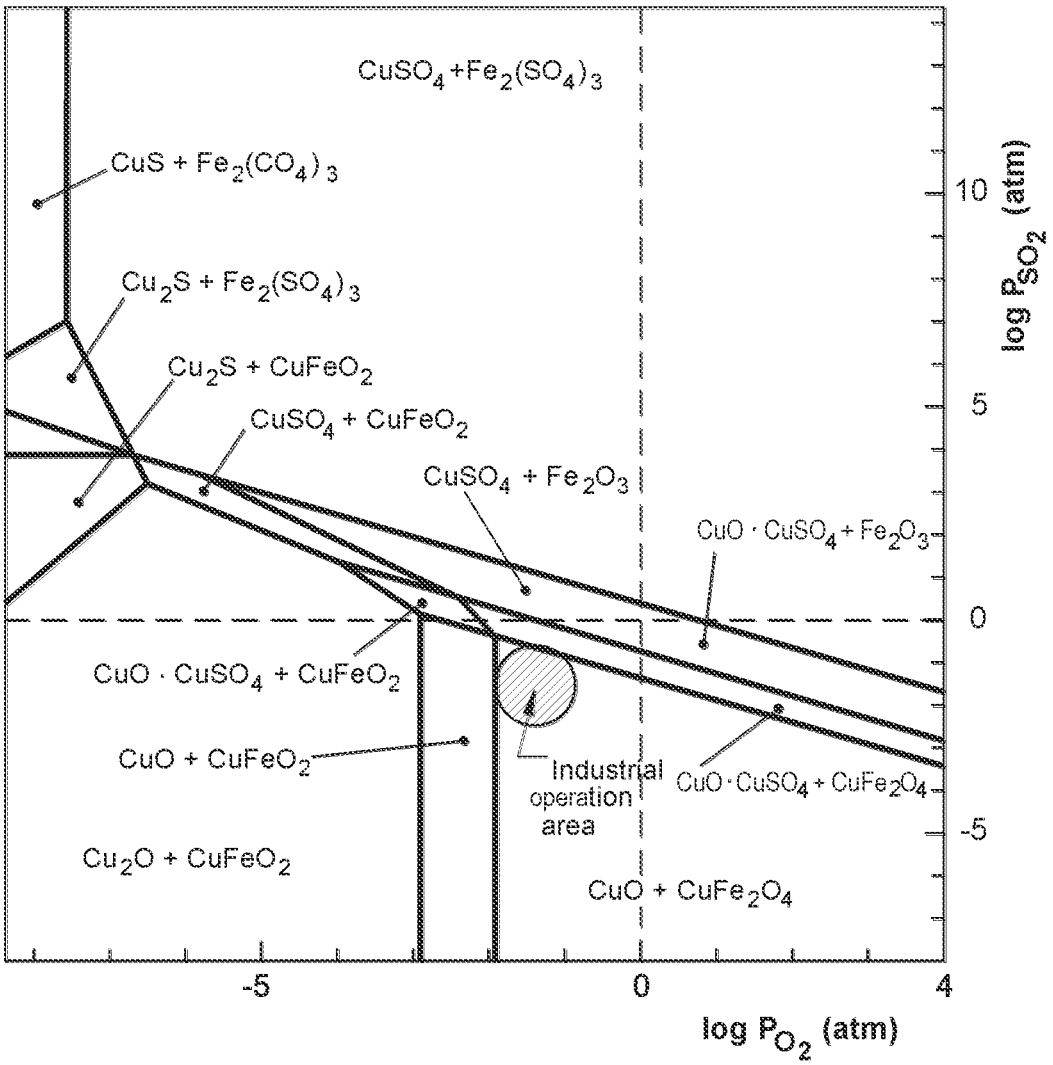
FIG. 3: Quaternary phase stability diagram Cu—Fe—S—O at 800° C. (Cu/Fe=2/1).

FIG. 3 shows the diagram of quaternary phase stability Cu—Fe—S—O at 800° C. under chemical equilibrium conditions as a function on the partial pressures of oxygen (air) and sulfur dioxide ($SO_2$) for the reactions that occur in the fluidized bed 5, where the stability area of the copper and iron compounds formed in the calcine can be observed under the operating conditions of an industrial reactor.

If the concentrate contains zinc, for example, as sphalerite ($ZnS$), it is oxidized to $ZnO$ according to the reaction:

$$ZnS_{(s)}+1.5O_{2(g)}=ZnO_{(s)}+SO_{2(g)} \quad (6)$$

If the concentrate contains molybdenum as molybdenite ($MoS_2$), it is oxidized to trioxide ($MoO_3$) which is volatile at about 650° C. and then condenses with the powders of the electrostatic precipitator, from where it can be recovered by leaching the powders in conventional form, for example, with a solution of ammonium hydroxide to then precipitate the ammonium molybdate, this being a commercial product.

The oxidation reaction occurring in the roasting reactor is as follows:

$$MoS_{2(s)}+3.5O_{2(g)}=MoO_{3(g)}+2SO_{2(g)} \quad (7)$$

All these reactions are exothermic, that is, they generate heat so that the reactor 3 does not require additional heat, furthermore, its hot gases 6 pass to a conventional boiler 7 to recover some of the heat as high-pressure steam for industrial use.

The sulfur contained in the copper concentrate 1 fed to the reactor 3, and where over 99% of it is oxidized to sulfur dioxide ($SO_2$), leaves the reactor with the gases 6, which after cooling to 400-450° C. in the boiler 7 are cleaned in conventional cyclones 9, and then again cooled to 300-320° C. in a conventional evaporative chamber 10 using sprayed water 11. The exhaust gases 12 end up being cleaned in a conventional electrostatic precipitator 19. The powder 8 of the electrostatic precipitator can be returned to the reactor 3 and the cleaned gases 20 are washed in a conventional gas washer 21.

If the initial copper concentrate 1 contains arsenic, it can be precipitated from the effluent 22 of the gas washer 21 in conventional form, for example, as ferric arsenate (scorodite). The clean gases 23 eventually go to a conventional acid plant 24 to produce sulfuric acid 25 for sale.

The oxidized calcine containing essentially cupric oxide ($CuO$), hematite ($Fe_2O_3$), cupric ferrite ($CuO\cdot Fe_2O_3$), zinc oxide ($ZnO$), silica ($SiO_2$) and other sterile such as silicates, hot discharge 14 of the roasting reactor 3 and together with the powders 13 generated in the boiler 7 and in the cyclones 9, 15 are joined to feed 17 the calcine reduction reactor 18, adding a reduction agent 16 such as coal, coke coal or carbon monoxide ($CO$) in an amount between 0.001 to 200% excess of the stoichiometric required to carry out reactions (8) to (11), preferably between 0.001 to 100% excess. Where the carbon monoxide ($CO$) gas is generated externally in a conventional carburetor and removing the sulfur, if any, in a conventional way in a limestone desulphurizer, ($CaCO_3$).

Optionally, it can be carried out using gas containing hydrogen between 10 to 20% by volume, at a temperature between 600 to 950° C., preferably between 700 to 800° C.

The reduction reactor 18 may be a conventional one such as a rotary kiln, in which the charge 27 of calcines and reducer generate carbon monoxide ($CO$) to reduce the oxides of copper, iron and zinc (if any) according to the following reactions:

$$CuO_{(s)}+CO_{(g)}Cu_{(s)}+CO_{2(g)} \quad (8)$$

$$3Fe_2O_{3(s)}+CO_{(g)}=2Fe_3O_{4(s)}+CO_{2(g)} \quad (9)$$

$$3CuO\cdot Fe_2O_3+4CO_{(g)}=3Cu_{(s)}+2Fe_3O_{4(s)}+4CO_{2(g)} \quad (10)$$

$$ZnO_{(s)}+CO_{(g)}Zn_{(g)}+CO_{2(g)} \quad (11)$$

Figure 4:
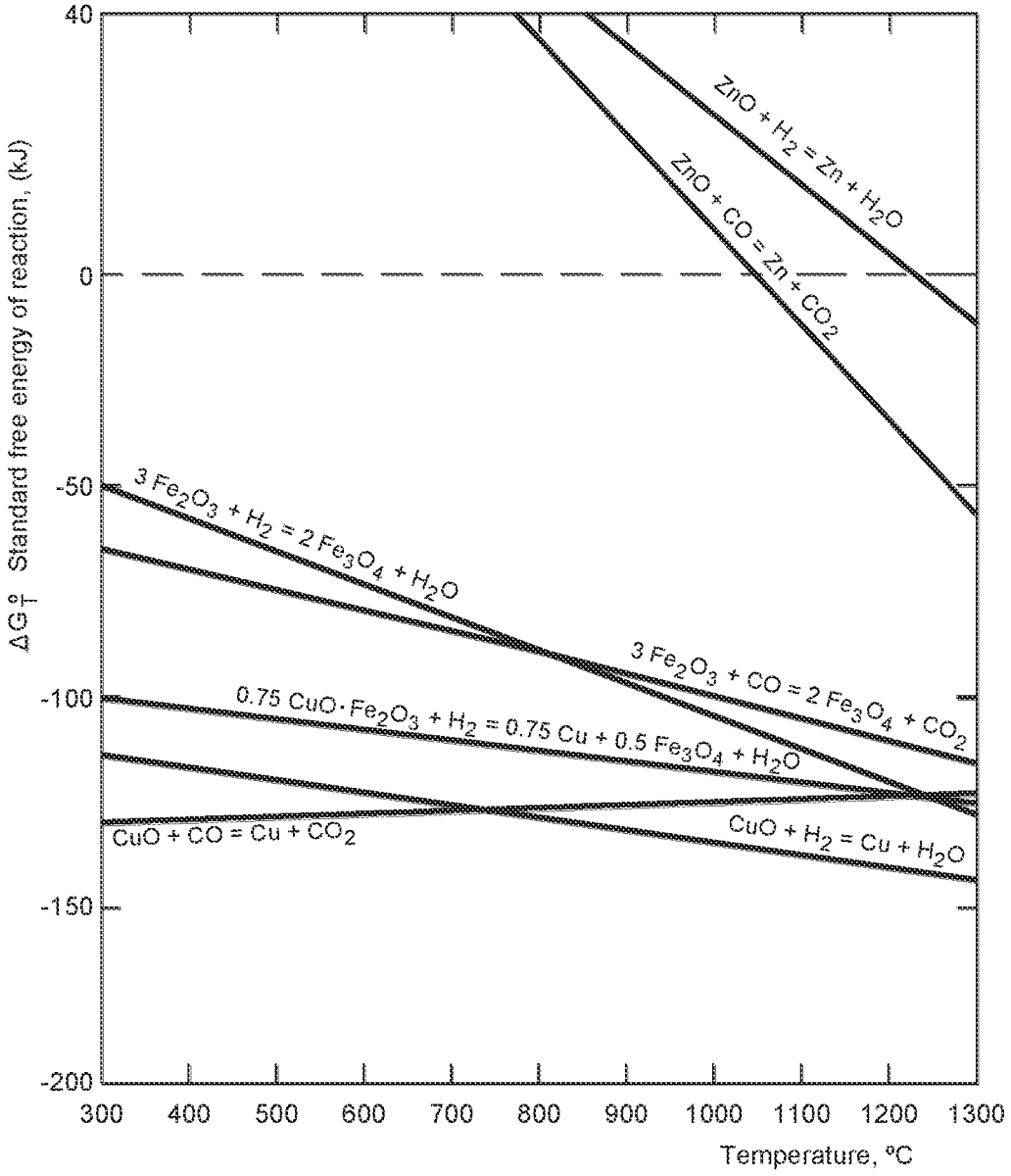
FIG. 4: Diagram of the standard free energies of reduction reaction with carbon monoxide and with hydrogen.

FIG. 4 shows the diagram of the standard free energies of the reduction reactions with carbon monoxide ($CO$) as a function of temperature for reactions (8) to (11). It is observed that all reactions have a negative value of the standard free energy of reaction (spontaneous) between 300-1300° C., however, the reduction of zinc oxide ($ZnO$) to gaseous metal zinc with carbon monoxide ($CO$) requires a temperature higher than 1000° C.

Figure 5:
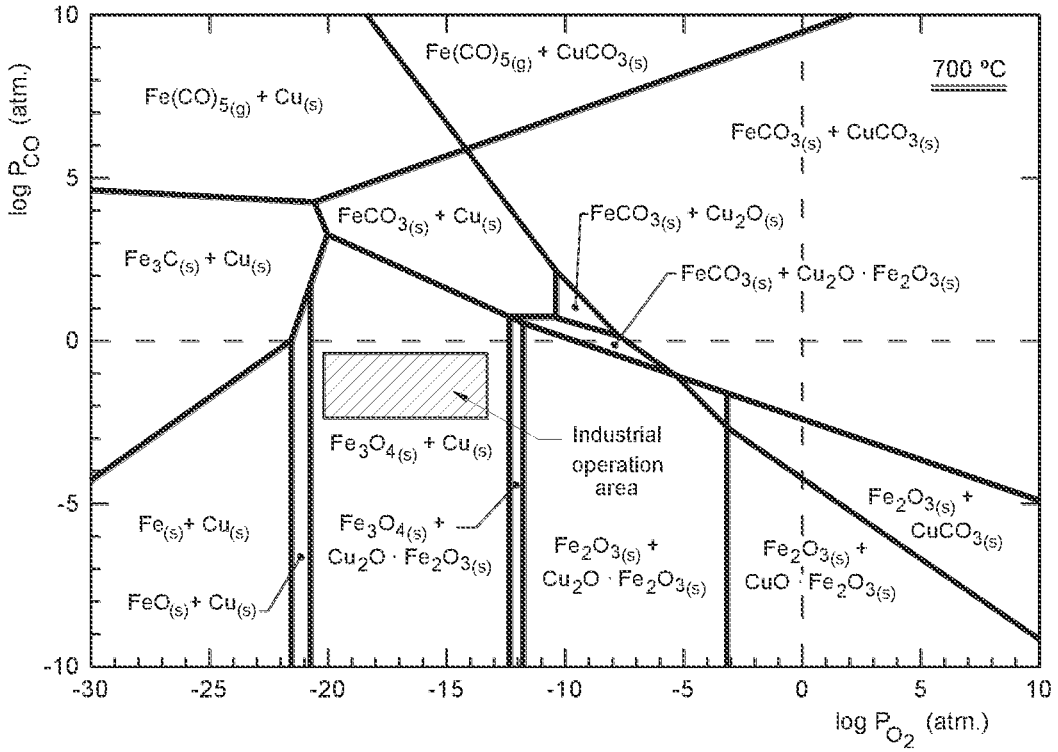
FIG. 5: Diagram of Quaternary phase stability Cu—Fe—C—O at 700° C.

FIG. 5 shows the diagram of quaternary phase stability Cu—Fe—C—O at 700° C. as a function of the partial pressure of the reducer ($CO$) and the partial pressure of the oxygen in the gas phase, indicating the operating area of an industrial reduction reactor in which the metallic copper ($Cu$) and the ferrous-ferric oxide (magnetite) of iron ($Fe_3O_4$) are stable.

All reduction reactions (8) to (11) are exothermic, so that the reduction reactor 18 does not require additional heat to operate. The operating temperature of this reactor ranges between 500 to 950° C., preferably between 700 to 800° C. with a reaction time between 2 to 6 h. If necessary, conventional fuel such as natural gas or oil 26 can be added to the reduction reactor 18.

The exhaust gases 29 from the reduction reactor 18 are cleaned in one or more conventional cyclones 30. The reduced calcine in the reactor 18 discharges 28 together with powders 31 separated into conventional cyclones 30 and the mixture 32 of calcines 28 and powders 31 discharges directly into a stirred pond with conventional water 33 operating at a liquid temperature between 20 to 60° C., where the violent thermal shock of the hot calcine and cold water results in the fracturing and release of any metallic copper particles trapped in the magnetite (generated by the reduction of the cupric ferrite, according to reaction (9)). The steam generated is continuously removed 35 from the stirred pond, which maintains the temperature of the water in the desired range by a conventional heat exchanger 77. If required, the resulting pulp 37 may be wet ground in a conventional rod or ball mill 68 to complete the release of the copper metal from the magnetite.

If the copper concentrate contains zinc, to reduce zinc oxide to gaseous metal zinc it is required to operate the reduction reactor with a zone at temperature over 1000° C. to produce the reduction reaction (11). In such a case, the gaseous zinc contained in the gas 70 generated in the reduction reactor 18 according to reaction (11) is re-oxidized with cold air 72 in a conventional gas mixer such as a Venturi 71, where the gaseous zinc is oxidized according to the reaction:

$$2Zn_{(g)}+O_{2(g)}=2ZnO_{(s)} \quad (12)$$

The gases 78 containing fine zinc oxide are cleaned in a conventional equipment 73 such as a bag filter to recover zinc oxide for sale 74. The clean gases 75 can be vented into the atmosphere.

The pulp of calcine and water generated 37 in the stirred pond 33 or generated in that of the mill 68 is brought 69 to a magnetic separation system in conventional wet drums 38 of one or more stages and with a field density between 18,000 to 20,000 Gauss in which the magnetite ($Fe_3O_4$), which is strongly ferromagnetic, is separated from the non-magnetic rest formed by particles of metallic copper, silica and other inert materials such as silicates and the noble metals that could accompany the copper concentrate. In this way, a high magnetite law concentrate 39 is obtained which is brought to a conventional thickening step 40. The low flow of the thickener 79 is brought to a conventional filtering step 41 and the final check of magnetite concentrate 42 is sold. Both the clear water 43 of the thickener 40 and the filtrate 44 of the filter 41 are recirculated 34 to the stirred pond 33.

The non-magnetic fraction 45 containing the copper and other non-magnetic materials is carried to a flotation step 46, wherein silica and other inerts such as silicates present in conventional form are floated, for example, at pH between 10 to 10.5 employing conventional collectors and foams, such as dodecylammonium acetate and potassium nitrate ($KNO_3$) and with a flotation time of 5 to 8 minutes to generate a pulp 47, which is thickened in a conventional thickener 48. The low flow 49 thereof is brought to a conventional filtering step 50 to generate a concentrate of silica and other sterile 52 for sale, for example, as copper flux.

The final tail (pulp) 54 generated in the flotation step 46 contains virtually all of the copper and noble metals such as fine metallic particles, which are thickened in a conventional thickener 55, and the low flow 56 is brought to a conventional filtering step 57. The copper metal check is washed with fresh water 76 in the filter, and the final check of copper and noble metals 58 is brought to storage 59 from where it is loaded 60 to a conventional smelting furnace 61 such as an electric induction furnace, to thus have copper metal 62 equivalent to the blister copper together with the noble metals dissolved therein, for subsequent conventional electrolytic refining.

Both the clear water 66 and 53 of the thickeners 48 and 55 and the filtrate 52 and 67 of the filters 50 and 57 are recirculated to the process 34, to the pond 33.

Any slag that may be formed 63 in the smelting stage 61 is cooled and ground in a conventional milling equipment 64 and recirculated 65 to the roasting reactor 3 to recover the copper contained therein. If zinc has not been reduced, it will be contained in this slag 63 as oxide (ZnO) which can be recovered by leaching the slag in conventional form, for example, with a dilute solution of sulfuric acid and then electrodepositing the zinc therefrom.

Figure 6:
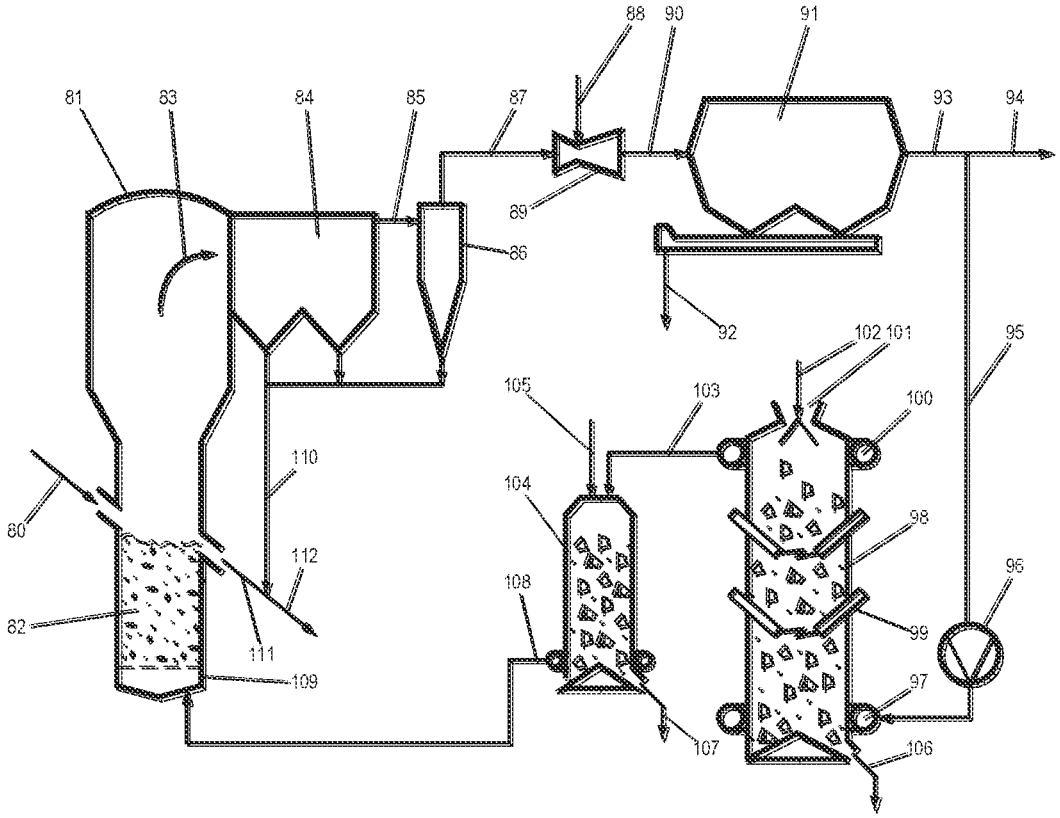
FIG. 6: Process diagram of a technological alternative with a fluidized bed reactor.

The step of reducing the oxidized calcines 15 generated in the reactor 3 can also be carried out in a gas fluidized bed reactor containing carbon monoxide (CO) generated externally in a carburetor. The schematic diagram of this technological alternative is shown in FIG. 6.

In this technological alternative, the oxidized calcine 80 coming from the roasting reactor is fed to a conventional fluidized bed reactor 81, in which in the reaction bed 82 the reactions described above Nos. (8) to (11) occur. The reaction gases and the entrained solid 83 pass to a conventional heat recovery boiler 84 to lower the gas temperature to 350-400° C. and recover heat as process steam. The solid collected goes to process 110. The gases 85 are then cleaned in one or more hot cyclones 86 where most of the solid entrained by the gases is separated and this is joined with the separated solid in the boiler 84 to bring it to process 110 together with the calcine 111 discharging from the reactor 81. The mixture 112 of hot calcine 111 and powders 110 discharges into a stirred pond with water, just like the pond 34 described in FIG. 1.

The rest of the calcine process is equal to that described above.

The hot gases 87, over 300° C., are cooled with cold air 88 in a conventional gas mixer 89 such as in Venturi to oxidize and condense zinc oxide (ZnO) according to reaction (12). The gases containing zinc oxide are taken 90 to a conventional bag filter 91 where zinc oxide (ZnO) 92 is recovered for commercialization.

The exhaust gases 93 of the bag filter 91, a part is discarded 94 into the atmosphere to maintain the oxygen balance in the system. The remainder 95 is compressed with a conventional compressor 96 and brought to a conventional carburizing equipment or carburetor 98 fed with metallurgical coke coal 102, which is fed to the upper part 101 of the carburetor 98, which operates at 700-800° C. to generate the CO formation reaction (Bouduard reaction) according to:

$$C_{(s)}+CO_{2(g)}=2CO_{(g)} \quad (13)$$

This reaction is endothermic and requires heat which is supplied by arc electrodes 99 or other conventional means. The gas containing oxygen, ($O_2$), nitrogen ($N_2$) and carbon dioxide ($CO_2$) enters the lower part 97 of the carburetor 98 and exits its upper part 100 with virtually only carbon monoxide (CO) and nitrogen ($N_2$), since oxygen reacts with the coke coal to produce carbon monoxide (CO) according to the reaction:

$$2C_{(s)}+O_{2(g)}=2CO_{(g)} \quad (14)$$

The ashes from the coke coal 106 discharges through the lower part of the carburizing reactor 98.

The hot gas 103 exiting the upper part 100 of the carburetor 98 is brought to a sulfur capture reactor or desulphurizer 104 in the event that the coke coal contains sulfur, which would contaminate the calcine 112 generated. The desulphurizer is fed with limestone ($CaCO_3$) 105, which over 700° C. reacts with the gaseous sulfur generated in the carburetor 98 according to:

$$2CaCO_{3(s)}+S_{2(g)}=2CaS_{(s)}+2CO_{2(g)}+O_{(g)} \quad (15)$$

The oxygen generated oxidizes the CO of the gas to $CO_2$, but because the sulfur present in the coke coal 102 does not always exceed 0.5%, the reaction (15) occurs to a very limited extent. Discharge 107 from desulphurizer 104 can be discarded.

The clean gas with carbon monoxide (CO) and a small amount of $CO_2$ and free of sulfur 108 is injected into the lower part 109 of the fluidized bed reduction reactor 81 to reduce the oxidized calcine according to what is explained above.

In addition to this alternative, the carbon monoxide (CO) reducing gas can be replaced by hydrogen ($H_2$). The advantage of using hydrogen ($H_2$) as a reducer is its generation external to the plant and that it can be injected directly into the reactor by mixing it with an inert gas such as nitrogen, since the reactions are pure and very violent, so that it can be diluted to 10-20% by volume. In addition, only water is generated as a product of the reduction reactions, which can be reused. Reactions that occur with hydrogen are as follows:

$$CuO_{(s)}+H_{2(g)}=Cu_{(s)}+H_2O_{(g)} \quad (16)$$

$$3Fe_2O_{3(s)}+H_{2(g)}=2Fe_3O_{4(s)}+H_2O_{(g)} \quad (17)$$

$$3CuO\cdot Fe_2O_{3(s)}+4H_{2(g)}=3Cu_{(s)}+2Fe_3O_{4(s)}+4H_2O_{(g)} \quad (18)$$

$$ZnO_{(s)}+H_{2(g)}=Zn_{(g)}+H_2O_{(g)} \quad (19)$$

As can be seen in FIG. 4, the reduction of oxidized copper and iron calcines with hydrogen is possible throughout the temperature range considered, however, the reduction of zinc oxide requires a temperature over 1200° C., which is above the melting point of some phases present, so that if the copper concentrate contains zinc, the zinc oxide formed will end up as such together with the copper metal, from where it can be recovered from the slag by smelting copper and noble metals. Zinc oxide is readily soluble in dilute sulfuric acid, as indicated above.

Figure 7:
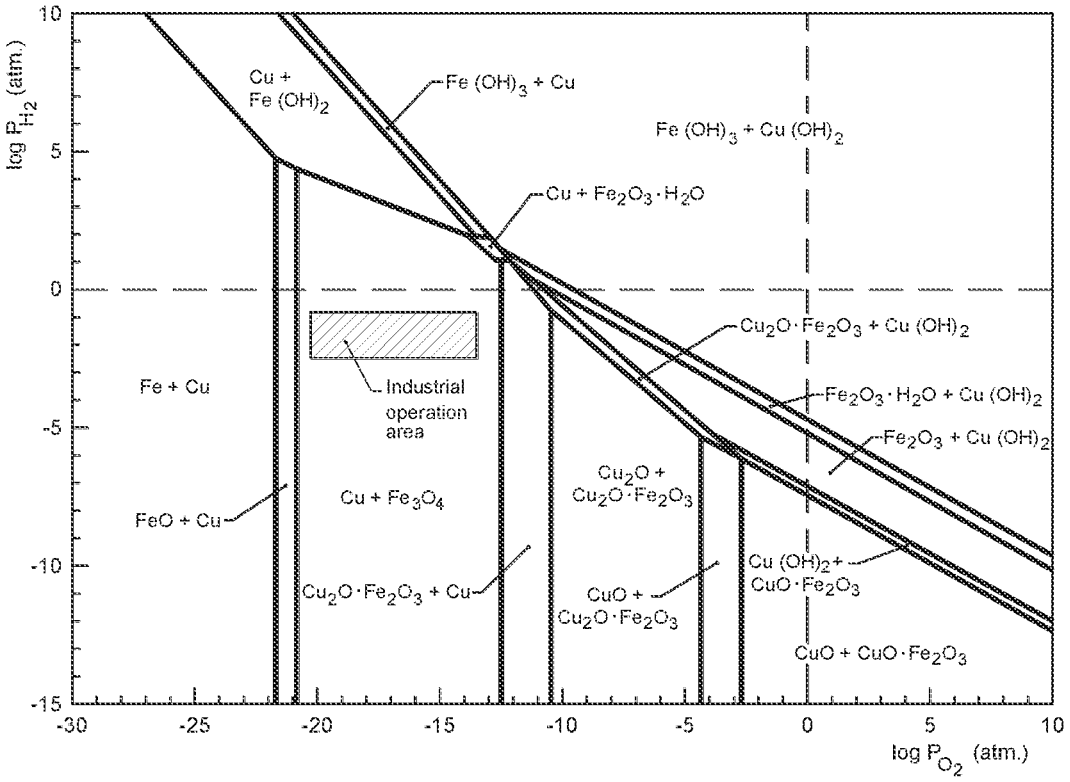
FIG. 7: Diagram of Phase stability Cu—Fe—$H_2$—$O_2$ at 700° C.

FIG. 7 shows the diagram of phase stability Cu—Fe—$H_2$—$O_2$ at 700° C. as a function of the partial pressure of hydrogen ($H_2$) and partial pressure of oxygen ($O_2$), indicating the stability area of the stable phases of copper metal and magnetite ($Fe_3O_4$).

Figure 8:
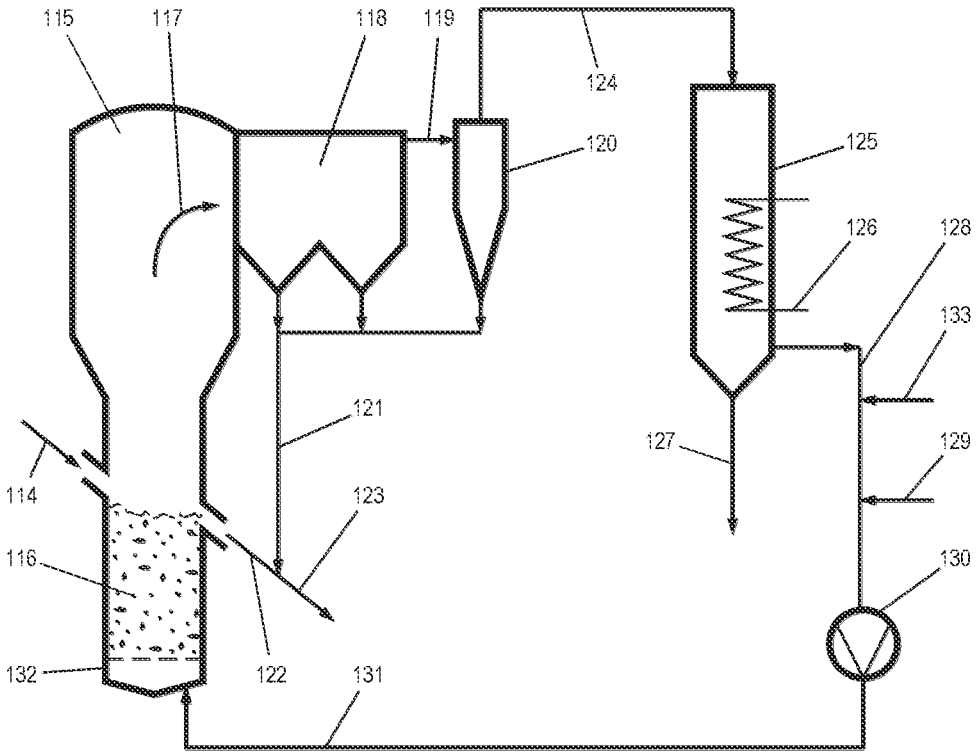
FIG. 8: Process diagram of a technological alternative using hydrogen.

The process diagram of this technological alternative is shown in FIG. 8. The oxidized calcine 114 coming from the oxidizing roasting reactor is continuously fed to a conventional fluidized bed reactor 115, in which in its bed 116 the reduction reactions with hydrogen ($H_2$) Nos (16) to (19) occur at a temperature between 400 to 900° C., preferably between 600 to 800° C. with a reaction time of 0.5 to 12 h, preferably between 4 to 6 h, and which is fluidized with a gas containing between 1 to 90% by volume of hydrogen, preferably between 10 to 20% by volume and the rest of the nitrogen gas ($N_2$) or other inert gas. The reaction time of the solid in the bed 116 ranges from 2 to 8 h, preferably between 4 and 6 h.

The hot gases 117 also entraining solid particles are cooled to 350-400° C. in a conventional boiler 118 generating steam for industrial use and the gases 119 are then cleaned in one or more conventional hot cyclones 120. The clean gas 124 is then cooled in a conventional condenser 125 cooled by water 126 where it condenses the water 127 generated in reactions (16) to (18), which can be used as industrial water.

More fresh hydrogen ($H_2$) 133 and nitrogen ($N_2$) 129 are added to the outlet gas 128 of the condenser 125, if necessary, and compressed with a conventional compressor 130 and injected 131 into the bottom 132 of the fluidized bed reactor 115. In this technological option there is no emission of gases to the environment and the gas is continuously recirculated in the process and the only liquid product is recoverable water.

The powders 121 separated in the boiler 118 and cyclones 120 are joined with the calcine 122 and discharge 123 to a pond equal to the pond 34 described in FIG. 1. The rest of the process is equal to that described in FIG. 1 for reduced calcines.

Application Example

A copper concentrate with the chemical composition indicated in Table 1 and mineralogical of Table 2 was toasted in a continuous fluidized laboratory bed reactor at 800° C. (±10° C.) with a mean reaction time of 4 h at a feed rate of 5 kg/h and an excess of 100% of the air over the stoichiometric required by reactions (1) to (5). The particle size of the concentrate was 80%-100 mesh.

TABLE 1

Chemical composition of the copper concentrate used

| Element | Cu | Fe | S | $SiO_2$ | Others |
|---|---|---|---|---|---|
| % | 28.2 | 22.3 | 34.1 | 8.9 | 6.5 |

TABLE 2

Mineralogical composition of the copper concentrate used

| Compound | Chalcopyrite ($CuFeS_2$) | Chalcocite ($Cu_2S$) | Covellite ($CuS$) | Bornite ($Cu_5FeS_4$) | Pyrite ($FeS_2$) | Silica ($SiO_2$) | Others — |
|---|---|---|---|---|---|---|---|
| % | 19.9 | 24.3 | 1.0 | 3.2 | 31.2 | 8.9 | 9.8 |

The calcine along with the collected powders was cooled to 20° C. and analyzed chemically and mineralogically. The composition of this is shown in Tables 3 and 4.

TABLE 3

| Chemical composition of the obtained calcine | | | | | |
|---|---|---|---|---|---|
| Element | Cu | Fe | S | $SiO_2$ | Others |
| % | 32.4 | 24.6 | 0.31 | 9.9 | 31.8 |

TABLE 4

| Mineralogical composition of the obtained calcine | | | | | |
|---|---|---|---|---|---|
| Element | Cuprite (CuO) | Hematite $Fe_2O_3$ | Copper ferrite ($CuO \cdot Fe_2O_3$) | Silica $SiO_2$ | Others — |
| % | 41.6 | 24.1 | 17.2 | 12.8 | 3.3 |

In the roasting step, 99.3% of the sulfur contained in the initial concentrate was removed to the $SO_2$ form. The composition of the reactor exhaust gas was 12.5 to 13% by volume of $SO_2$.

The calcine was then continuously reduced in a fluidized laboratory bed furnace by employing a mixture of $CO+CO_2$ in $CO/(CO+CO_2)=0.5$ to 800° C. for a mean reaction time of 2 h, feeding at a rate of 4 kg/h, and employing 20% of excess CO over the stoichiometric required by reactions (8) to (10).

The calcine was cooled directly in water to 30° C. and analyzed chemically and mineralogically. The results are seen in Table 5.

TABLE 5

| Chemical composition of reduced calcine | | | | | |
|---|---|---|---|---|---|
| Element | Metallic copper (Cu) | Magnetite ($Fe_3O_4$) | Total Sulfur (S) | Silica ($SiO_2$) | Others — |
| % | 48.7 | 34.2 | 0.03 | 14.8 | 0.3 |

The calcine pulp with 25% solid was magnetically concentrated in a magnetic laboratory drum system in four stages with 400 Gauss/cm each, portraying the intermediate tails generated (in each stage) in three stages. The final magnetite concentrate contained 94.2% of magnetite ($Fe_3O_4$), 4% of silica ($SiO_2$) and 0.8% of others, with 0.1% of copper trapped.

The final tail (copper concentrate) contained 74.1% of metallic copper and 24.7% of silica, which was floated in three cleaning stages using 0.25 g/l of dodecylammonium and 0.05 g/l of potassium nitrate at pH 10 and removing 90.2% of the silica and other silicates and generating a concentrate of 92.9% of silica and 0.08% of copper.

The final tail contained the metallic copper, with a law of 98.9% of copper, 0.8% of silica and 0.8% of magnetite, which was melted in an electric furnace at 1200° C. to have an equivalent to the blister copper. The overall recovery of copper from concentrate to final copper metal was 98.7%.

The invention claimed is:

1. A process for producing copper metal from copper concentrates without generating waste comprising at least the following steps:

a. conducting an oxidation reaction by feeding a dry, or wet copper concentrate up to 12% of humidity, to a fluidized bed roasting reactor at 650-900° C. using air or oxygen-enriched air between 21 to 100% by volume of oxygen and an excess of oxygen with respect to a required stoichiometric amount for oxidation between 0.001 to 200%, and with a reaction time of 2-12 h;

b. conducting cleaning and cooling steps by cooling gases generated in the roasting reactor to 400-450° C. in a boiler and cleaning in cyclones and then cooling to 300-320° C. in an evaporative chamber, cleaning outlet gases in an electrostatic precipitator, wherein dust of the precipitator is returned to the roasting reactor and clean gases are washed in a gas washer, and finally sent to an acid plant to produce sulfuric acid;

c. feeding to a reduction reactor oxidized calcine from the roasting reactor and together with dust generated in the boiler and in the cyclones, are joined and fed to the reduction reactor, adding a reduction agent in an amount equal to or up to 200% excess of the stoichiometric amount required for the reduction reactions, operating at 500-950° C. with a reaction time between 2 to 6 h, using gas containing hydrogen between 10 to 20% volume or coke coal or carbon monoxide with an excess between 0.001 to 200% with respect to the stoichiometric amount required for the reduction reactions;

d. the entrained dust in the gases from the reduction reactor is separated in cyclones and the dust collected in the cyclones is combined with the calcines of the reduction reactor;

e. the calcines and dusts of the reduction reactor are mixed with water to form a pulp in a stirred tank operating at a temperature between 20 to 60° C., where the fracturing and release of metallic copper particles trapped in magnetite occurs, wherein the pulp generated in the stirred tank, optionally, is ground in a mill to complete the release of any metallic copper particles trapped in a matrix of magnetite formed during the reduction reaction;

f. conducting magnetic separation by having the pulp of calcine, dust, and water generated in the stirred tank or from the mill brought to a magnetic separation system in wet drums of one or more stages and with a field density between 18,000 to 20,000 Gauss in which the magnetite is separated from the non-magnetic rest, obtaining a magnetite concentrate g. thickening and filtering the magnetic concentrate by having the magnetite concentrate is sent to a thickening step, wherein a underflow of a thickener is fed to a filtering step to obtain a final cake of magnetite concentrate; and wherein an overflow of the thickener and filtering of the filter are recirculated to the stirred tank;

h. conducting flotation of silica and inerts by having the non-magnetic fraction containing the copper and other non-magnetic materials sent to a flotation step, where the silica and inerts are floated at pH between 10 to 10.5 employing collectors and foaming agents with a flotation time of 5 to 8 minutes to generate a pulp with the silica and inerts, and another pulp with the copper;

i. conducting thickening and filtration of silica and inerts by having the pulp with the silica and inerts thickened in a thickener, wherein the underflow is brought to a filtering step to generate a sterile silica concentrate;

j. conducting thickening and filtration of a final concentrate containing the copper metal and noble metals by having the pulp with of copper generated in the flotation step thickened in a thickener and the underflow sent to a filtering step, and wherein a metallic copper cake is washed with fresh water in a filter, and a final cake of copper and noble metals is brought to stockpile;

k. smelting of the final cake of copper and noble metals by loading the stockpile to a smelting furnace in order to obtain metallic copper together with the noble metals dissolved therein, for subsequent electrolytic refining;

l. recirculating a ground smelting slag to the roasting reactor by having the slag, formed in the smelting stage, cooled and ground in a milling equipment and recirculated to the roasting reactor to recover the copper contained therein.

2. The process for producing copper metal from copper concentrates without generating waste according to claim 1, wherein the roasting reactor operates at 700 to 850° C.

3. The process for producing copper metal from copper concentrates without generating waste according to claim 1, wherein in the roasting reactor the reaction time is from 4 to 8 h.

4. The process for producing copper metal from copper concentrates without generating waste according to claim 1, wherein molybdenum present in the copper concentrate is recovered from the dusts of the electrostatic precipitator of the cleaning and cooling stage of the roasting reactor gases, by leaching the dust with a solution of ammonium hydroxide prior to returning the dusts to the roasting reactor.

5. The process for producing copper metal from copper concentrates without generating waste according to claim 1, wherein in the reduction reactor the reducing agent is coke coal or carbon monoxide.

6. The process for producing copper metal from copper concentrates without generating waste according to claim 1, wherein in the reduction reactor the reducing agent is fed between 0.001 to 100% excess.

7. The process for producing copper metal from copper concentrates without generating waste according to claim 1, wherein the reduction reactor is a rotary kiln.

8. The process for producing copper metal from copper concentrates without generating waste according to claim 1, wherein the reduction reactor operates at 700 to 800° C.

9. The process for producing copper metal from copper concentrates without generating waste according to claim 1, wherein the reduction stage is carried out with carbon monoxide gas generated externally in a carburetor and removing any sulfur in a limestone desulfurizer.

10. The process for producing copper metal from copper concentrates without generating waste according to claim 1, wherein the collectors and foaming agents are dodecylammonium acetate or potassium nitrate.

11. The process for producing copper metal from copper concentrates without generating waste according to claim 1, wherein in the smelting stage of the final concentrate of copper and noble metals, the furnace is of electric induction.

12. The process for producing copper metal from copper concentrates without generating waste according to claim 1, wherein the reduction reaction step is carried out in a gas fluidized bed reactor containing carbon monoxide generated externally in a carburetor or in a hydrogen containing gas, as fluidizing gas and reducing agent.

* * * * *